United States Patent [19]

van Dijk

[11] 3,954,218

[45] *May 4, 1976

[54] METHOD AND APPARATUS FOR FORMING SHEET METAL AROUND TUBES

[76] Inventor: Edsger Wybe van Dijk, Albert Neuhuysstraat 25, Utrecht, Netherlands

[ * ] Notice: The portion of the term of this patent subsequent to Oct. 30, 1990, has been disclaimed.

[22] Filed: Feb. 20, 1974

[21] Appl. No.: 444,232

[30] Foreign Application Priority Data

Feb. 20, 1973 United Kingdom ..... 8327/73

[52] U.S. Cl. ..... 228/173; 29/157.3 C; 29/202 D; 113/1 C; 113/118 C; 228/15.1; 228/44.1 R; 219/104

[51] Int. Cl.[2] ..... B23K 11/10; B23P 15/26

[58] Field of Search ..... 113/118 C, 118 R, 1 C; 29/157.3 C, 202 D, 475, 477, 478, 479; 228/15, 44, 15.1, 44.1, 141, 164, 173; 72/401, 307, 383; 219/101, 104

[56] References Cited

UNITED STATES PATENTS

| | | | |
|---|---|---|---|
| 1,377,474 | 5/1921 | Gunther | 72/401 X |
| 2,732,615 | 1/1956 | Sandberg | 29/157.3 C |
| 3,135,045 | 6/1964 | Schane | 29/475 X |
| 3,461,711 | 8/1969 | Ogilvie | 72/383 |
| 3,768,294 | 10/1973 | van Dijk | 72/307 |
| 3,818,568 | 6/1974 | Sennstrom | 29/202 D |
| 3,838,590 | 10/1974 | van Dijk | 72/307 |

FOREIGN PATENTS OR APPLICATIONS

| | | | |
|---|---|---|---|
| 403,899 | 1/1934 | United Kingdom | 29/157.3 C |

*Primary Examiner*—C. W. Lanham
*Assistant Examiner*—D. C. Reiley, III
*Attorney, Agent, or Firm*—Blum, Moscovitz, Friedman & Kaplan

[57] ABSTRACT

An improved method for forming sheet metal around straight tubes and an apparatus for performing same is provided. A sheet is clamped along two parallel spaced apart locations by clamps by placing the straight part of the tube between said parallel locations, parallel with the clamps, and adjacent thereto. The clamps are then moved toward each other to thereby bend the sheet around the tube.

10 Claims, 19 Drawing Figures

METHOD AND APPARATUS FOR FORMING SHEET METAL AROUND TUBES

BACKGROUND OF THE INVENTION

This invention relates generally to a method and apparatus for forming sheet metal and especially to a method of utilizing clamping means to bend sheet metal around a part of, or an entire tubular surface. While bending and forming of sheet metal around straight tubes has become an essential step in the construction of heat exchangers, such methods which have heretofore been known have not provided adequate surface contact between the sheet metal and the tube. Furthermore, the necessity of providing a method and apparatus which enable tube runs to be located in sheet metal in parallel relation to thereby render same particularly suited as heat exchangers has not satisfactorily been achieved.

SUMMARY OF THE INVENTION

Generally speaking, in accordance with the invention, a method and apparatus for forming sheet metal around tubes is provided. The method is comprised of the steps of bending the sheet metal around the straight part of a tube by clamping the sheet along two parallel spaced apart locations by placing part of the tube between the parallel locations and adjacent therewith, and then moving the sheet clamping means toward each other to bend the sheet around the tube, the tube acting as a forming die for bending the sheet therearound. When flat sheets of metal are utilized, means are provided for forcing a part of the tube into the sheet to form a corrugation or U-section bed therein simultaneous with or prior to the clamping movement. Alternatively, in accordance with the instant method, precorrugated sheet metal can be utilized, the straight part of the tubes being inserted into the selected corrugations prior to the clamping step.

In accordance with the improved method of bending and forming sheet metal, after the sheet metal has been bent by clamping same, and the clamps are released, the sheet can be moved laterally so that subsequent forming can be effected at the clamping station, in accordance with a step-by-step process.

Apparatus for forming or bending sheet metal in accordance with the above-mentioned apparatus includes two pairs of clamp bar assemblies in parallel spaced relation for clamping at spaced locations across a sheet, and means for moving the assemblies toward one another. A die beam can be used to place pressure on the part of the tube opposite the sheet, means being provided for moving the beam up into the sheet to deform same. Sheet deformation is then carried out to deform the sheet around more than 180° of the tube surface, the clamps thereafter being moved together to bring the sheet portions below the tube into engagement. Welding means can be provided for securing the contacting sheet parts together.

Accordingly, it is an object of this invention to provide an improved method and apparatus for forming or bending sheet metal around straight tubes wherein there is adequate surface contact between the sheet metal and the tube.

Another object of this invention is to provide an improved method and apparatus for applying a deformation force to sheet metal for bending same around the straight part of the tube, the method and apparatus being adapted to stretch the sheet metal beyond its limits of elasticity to thereby avoid springback.

A further object of the invention is to provide a method and apparatus for forming and bending sheet metal in parallel relation about a straight part of a tube, to render said sheet metal and tubes particularly adapted for use in heat exchanger constructions.

Still other objects and advantages of the invention will in part be obvious and will in part be apparent from the specification.

The invention accordingly comprises the several steps and the relation of one or more of such steps with respect to each of the others, and the apparatus embodying features of construction, combination of elements and arrangement of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENT

Figure 1:
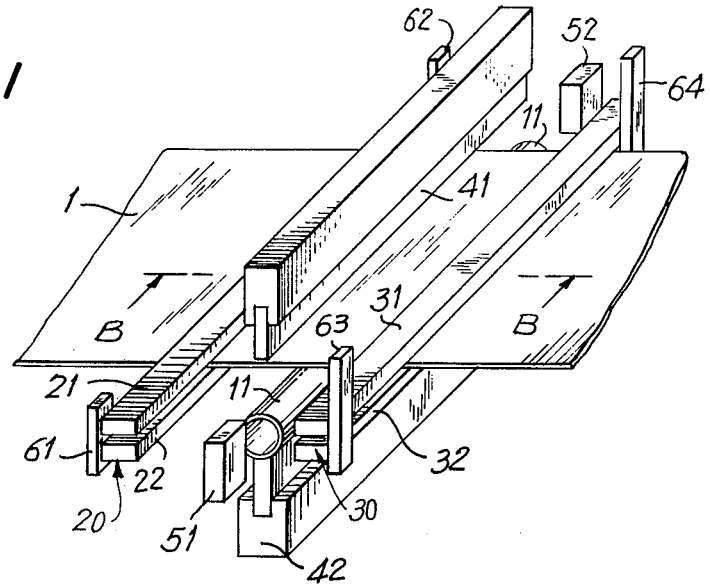
FIG. 1 is a perspective view of a clamping assembly constructed in accordance with the preferred embodiment of the instant invention.

Referring now to FIG. 1, an apparatus for folding sheet metal 1 around a tube 11 is depicted. The apparatus includes a die beam 42 having an upper surface with a shape to mate with and support tube 11. Although the tube 11 is depicted in FIG. 1 as being longer than the width of the sheet metal 1, it is noted that the only requirement with respect to the tube length is that it be at least as long as the sheet metal is wide.

The sheet metal is clamped on a first side of tube 11 by a clamp assembly 20 comprised of clamps 21 and 22 and is further clamped on the other side of tube 11 by a second clamp assembly 30, including clamps 31 and 32. Both clamp assemblies, 20 and 30, are adapted to move towards or away from each other symmetrically with respect to the vertical center line defined by the longitudinal axis of the tube 11.

The die beam 42 is vertically displaceable and is moved up and down during different aspects of the bending or folding operation. A counterbeam 41 is located above the work sheet in vertical alignment with the die beam 42 and is adapted to be vertically displaced by the upward movement of the die beam 42. It is appreciated that the necessity of providing a counterbeam 41 is eliminated if the sheet metal is extremely thin or if soft metal is to be bent.

Stoppers 51 and 52 are disposed between clamp assemblies 20 and 30 for limiting the inward displacement thereof. The stoppers are adapted to be displaced downward so as not to inhibit the movement of the clamp assemblies in a manner to be hereinafter discussed. The clamp assemblies 20 and 30 include displacement members 61 through 64, which members are part of a displacement mechanism (not shown) for displacing the clamp assemblies toward and away from each other.

Figure 2:
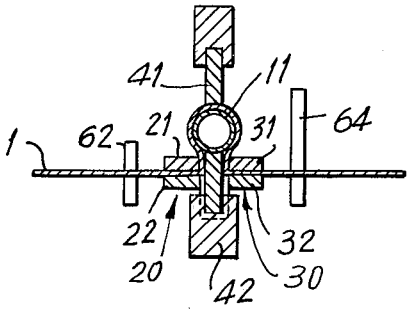
FIGS. 2 through 5 are sectional views taken along line B—B of FIG. 1, and depicting the operation of the apparatus depicted therein.
Figure 3:
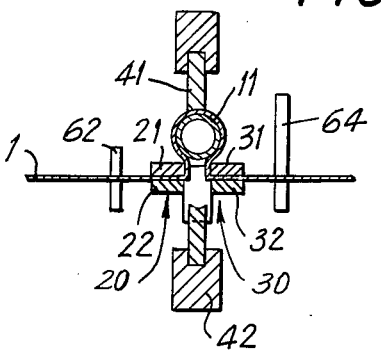
Figure 4:
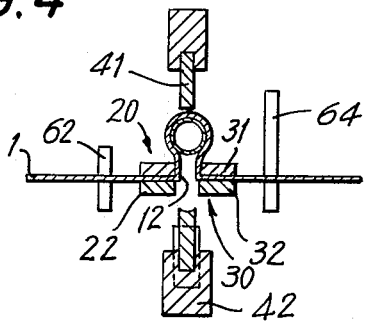
Figure 5:
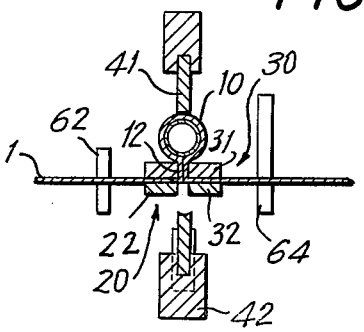

In operation, the clamp assemblies 20 and 30 are moved towards each other simultaneous with the upward displacement of die beam 42, the tube 11 upwardly displacing the sheet metal 1 and the counterbeam 41. The stops 51 and 52 stop the inward movement of the clamps as depicted in FIG. 2. The die beam 42 is then displaced downward to the position depicted in FIG. 3, and thereafter, stops 51 and 52 are also displaced downward as depicted in FIG. 4, to thereby allow the two clamp assemblies to move towards one another to the position depicted in FIG. 5. If the clamping force applied by clamps 21, 22, 31 and 32 is of sufficient force and the dimension of the sheet metal between them is selected so that the sheet metal is tightly folded around the tube 11, the sheet metal will not spring back but instead will remain in the position depicted in FIG. 5, with the surfaces 12 touching on release of the clamp assemblies. Nevertheless, in order to prevent later movements and distortion of the profile 10 of the sheet metal, the surfaces 12 of the sheet metal may be welded together by spot, cold press, ultrasonic or other well-known welding procedures.

Figure 6:
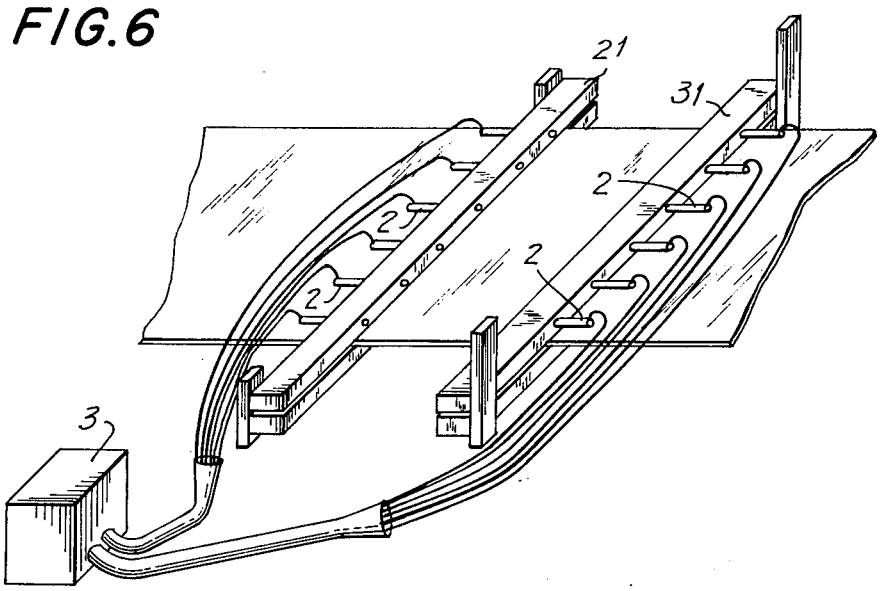
FIG. 6 is a perspective view of the clamps illustrated in FIG. 1, in combination with sheet fastening means constructed in accordance with the instant invention.

Reference is now made to FIG. 6, wherein a clamp assembly including upper clamps 21 and 31, having spot welding electrodes 2 disposed thereon is depicted. An electric power source 3 is provided for supplying energy to the electrodes 2. If a bending or folding apparatus were to include such welding means, such welding could be effected by pulsing all the electrodes at one time or by selectively energizing pairs of electrodes.

After the above-discussed folding operation, whether or not the surfaces 12 of the sheet metal are secured, the clamps are displaced away from each other and a pair of feeding clamps (not shown) or other such means for moving the sheets laterally, e.g., to the right in FIG. 1, are provided for positioning the next area to be folded in position. Accordingly, another tube is placed on the die beam 42 and the sheet metal is folded in the same manner hereinabove described, it being appreciated that the same process can be continuously repeated, so that a series of tubes can be equidistantly enclosed within the sheet metal 1.

It is noted that a pair of end sections, one at each end of the tube, when the tube projects beyond the sheet, can be utilized instead of a die beam 42 when the tube is of sufficient strength. It is appreciated that the use of a pair of end sections would remove the necessity of several steps hereinabove described. Still another alternative to the die beam 42 would be to support the tube with a rod running therethrough and extending from both ends, the rod being used to lift the tube in the upward direction.

Figure 7:
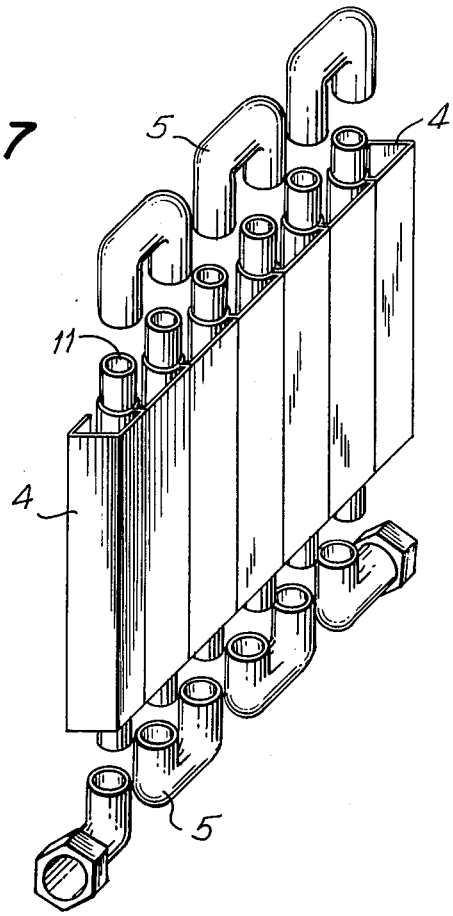
FIG. 7 is a perspective view of a sheet metal and tube construction constructed in accordance with the instant invention.

Referring to FIG. 7, there is depicted therein a heat exchanger construction in which sheet metal has been wrapped around a series of tubes 11. The ends of the sheet metal are bent, as indicated at 4, after the folding operation, such ends being used to support other components of the heat exchanger, e.g., a cover and bottom. U-bent couplers 5 are utilized to provide a continuous tube system, e.g., by butt welding.

Figure 8:
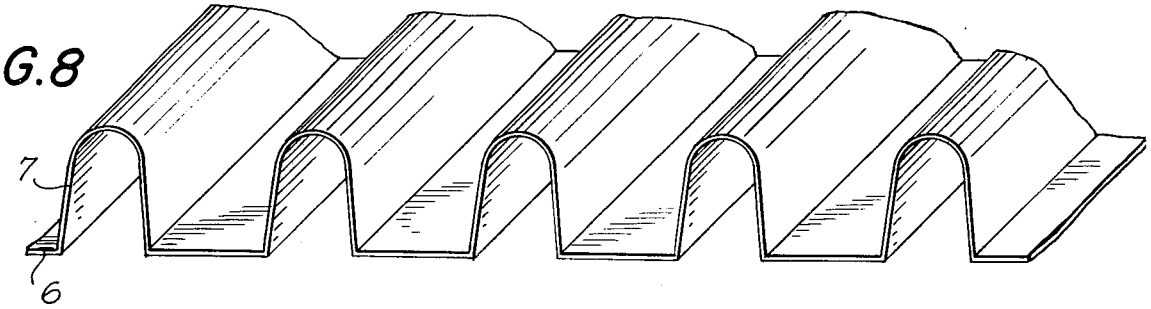
FIG. 8 is a corrugated sheet of metal particularly adapted to be folded around the straightened part of a tube, according to the method and apparatus of the instant invention.
Figure 9:
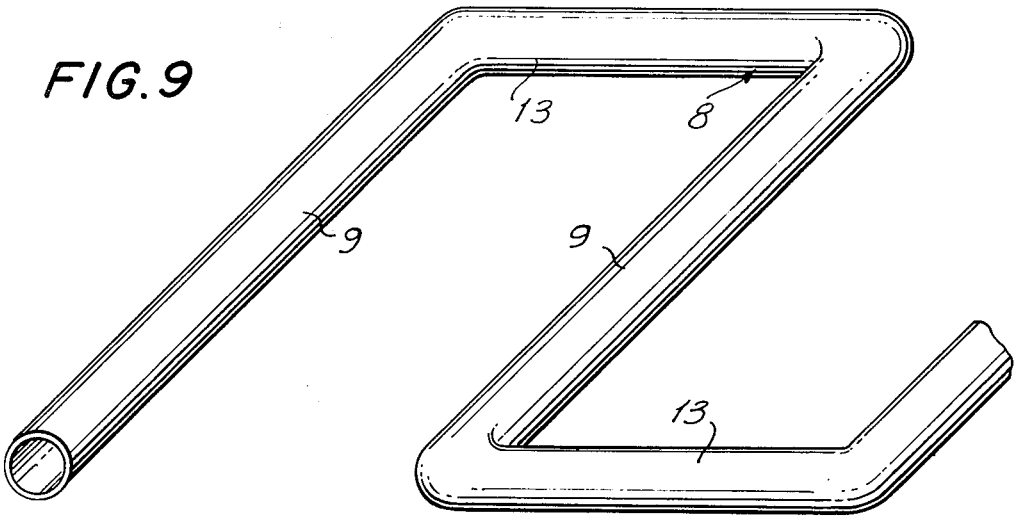
FIG. 9 is a perspective view of a tube for use with the corrugated sheet metal depicted in FIG. 8.
Figure 10:
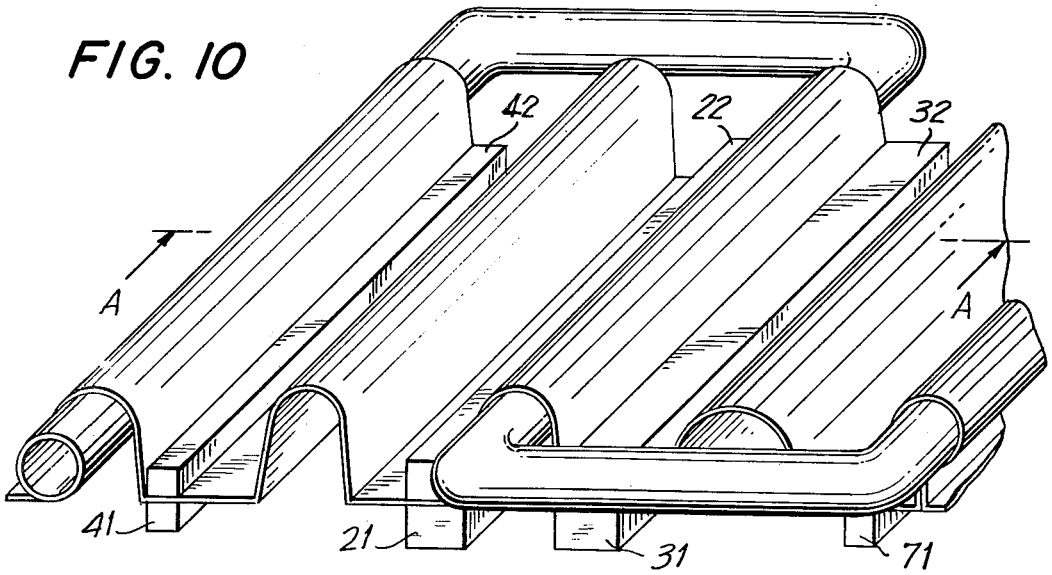
FIG. 10 is a perspective view of an apparatus for bending the sheet metal depicted in FIG. 8 around the tube depicted in FIG. 9.

Reference is now made to FIGS. 8 through 10, wherein a method and apparatus for forming corrugated sheet metal about a tube system in accordance with the instant invention is depicted. The conventional tube system, indicated generally as 8, is of the type utilized in heat exchangers and includes parallel equispaced tube portions 9 connected by end portions 13. The corrugated sheet metal 6 includes corrugations 7 corresponding in their upper internal cross-section to the outer cross-section of the tube portions 9 to thereby ensure a firm fit when the corrugated sheet is applied to the tube portions 9 as depicted in FIG. 10. In a preferred embodiment, the number of corrugations is selected so as to alternately embrace tube portions 9 with corrugations, i.e., to utilize N straight tube portions 9 with a sheet having 2N-1 corrugations and flat ends. It is noted that the end portions 13 of the tube system are preferably supported on flat surfaces when the sheet metal is to be wrapped around the tubular portions 9.

Figure 11:
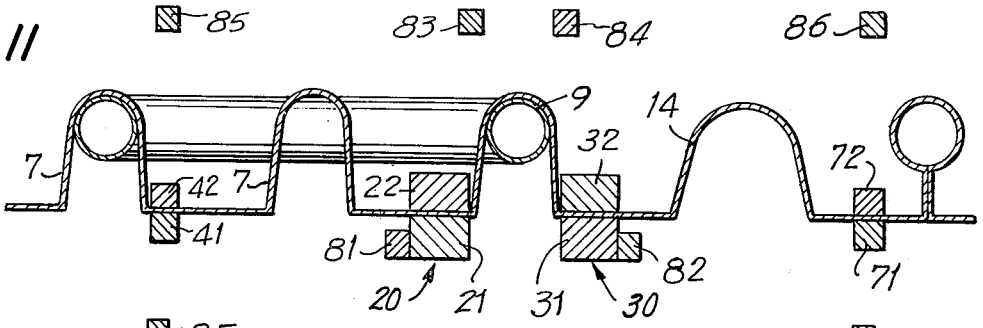
FIGS. 11 through 16 are sectional views taken along line A—A of FIG. 10 and depict the operation thereof.
Figure 12:
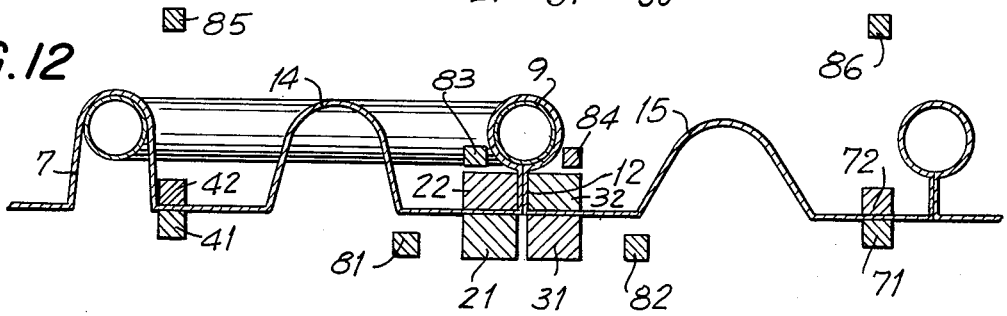
Figure 13:
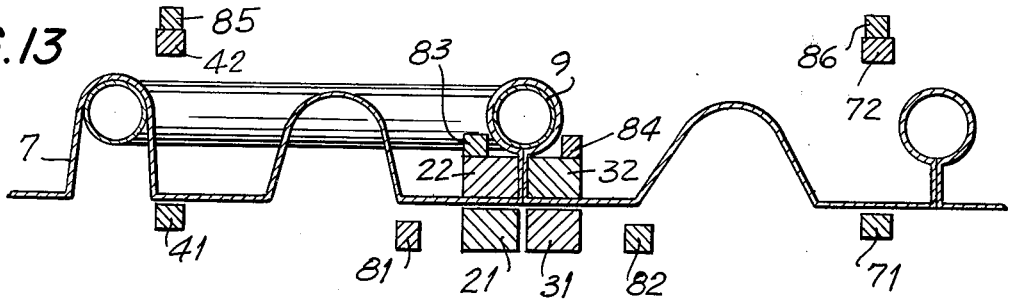
Figure 14:
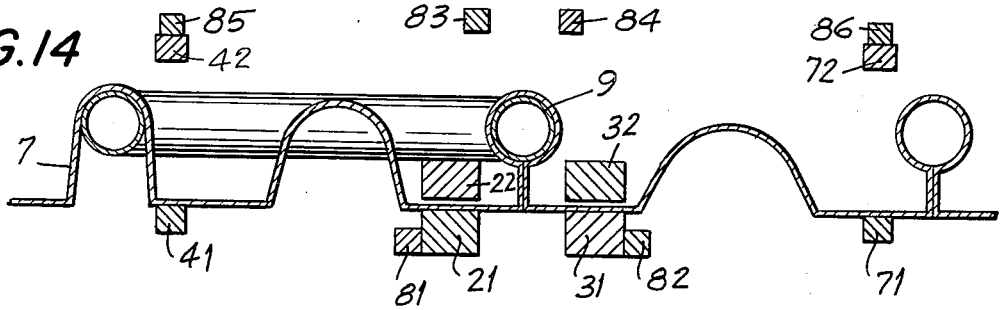
Figure 15:
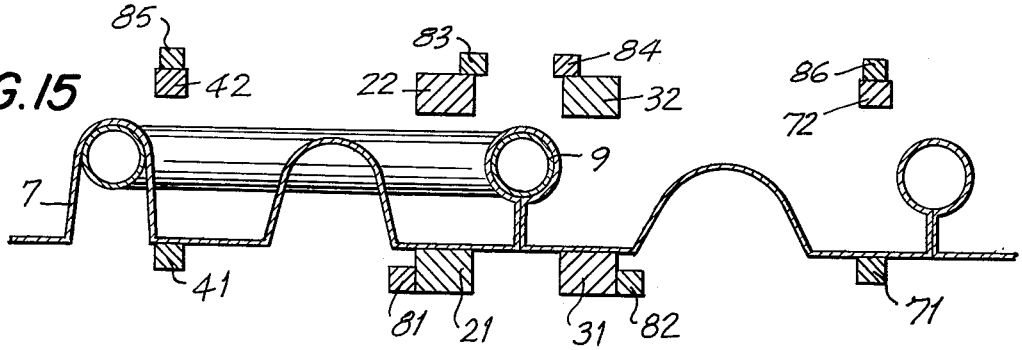
Figure 16:
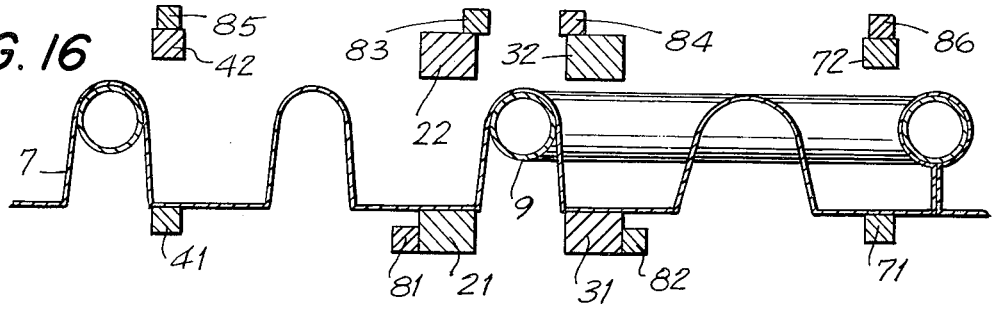

Reference is now made to FIGS. 11 through 16, wherein the apparatus and method of forming such corrugated sheet metal around tube system 9 is depicted, like numbers depicting like elements. Additional clamps 41 and 42 and 71 and 72 are disposed at each side of the corrugation to be further formed, to firmly secure the assembly during operation thereon. Clamps 42 and 72 are vertically displaceable to aid in the processing of the tube system and corrugated sheet metal. In operation, clamp assemblies 20 and 30 are moved towards each other, thereby bending the sheet metal around tube portion 9 and widening corrugation 7 to the shape depicted as 14 and corrugation 14 to the shape 15 depicted in FIG. 13. When the surfaces 12 of the sheet parts are brought into contact with each other, they can be secured and the sheet-metal-covered tube released. The upper clamps 42 and 72 of clamps 41 and 42 and 71 and 72, respectively, are vertically displaced into contact with limit stops 85 and 86. The upper clamp parts 22 and 32 of clamp assemblies 20 and 30 are also slightly upwardly displaced with the tube system and sheet metal into contact with limit stops 83 and 84, which have been downwardly displaced from their position depicted in FIG. 11 to the position depicted in FIG. 13. The clamp assemblies 20 and 30 are then moved away from each other until their displacement is halted by limit stops 81 and 82, as depicted in FIG. 14, and then upper clamps 22 and 32 are upwardly displaced to the position depicted in FIG. 15, stops 83 and 84 having been moved to their upper position. The tube system and sheet metal is now moved to the right to the position depicted in FIG. 16, and the process is repeated, with the apparatus being the same as depicted in FIG. 11. It is noted that at the commencement of the forming operation, when the corrugated sheet metal and tube system is placed in the apparatus, clamp 72 should be in a raised position during the first bending operation, and clamp 42 should be raised during the final bending operation.

Figure 17:
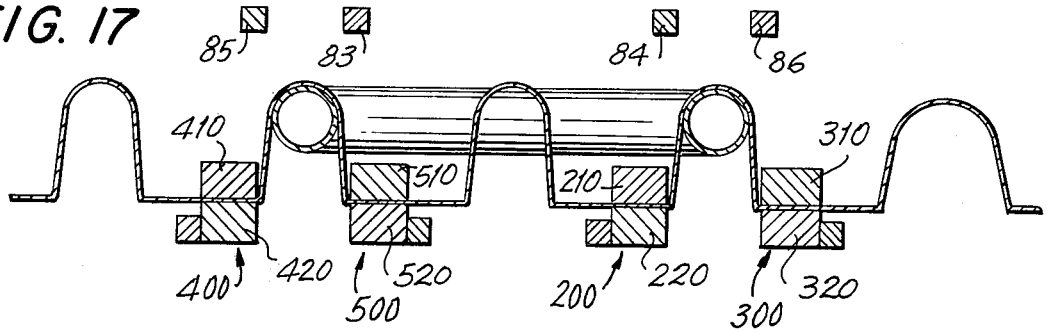
FIGS. 17 and 18 are sectional views of an apparatus for simultaneously folding sheet metal around two tubes in accordance with the method and apparatus of the instant invention.
Figure 18:
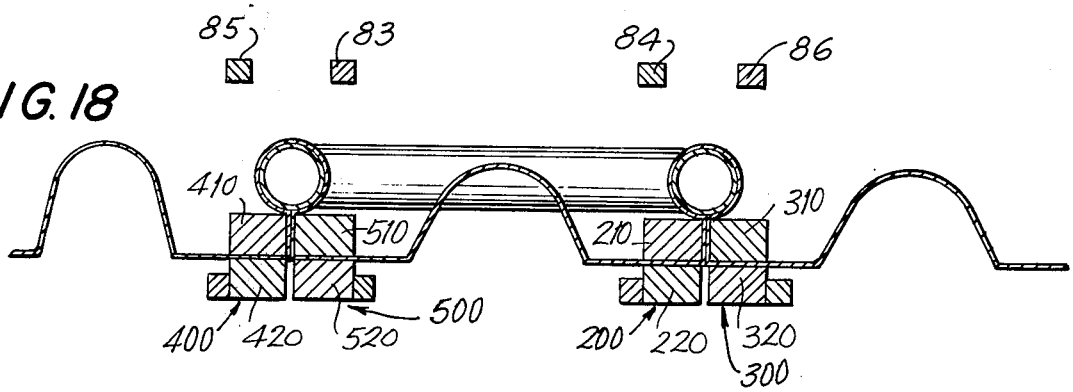

Reference is now made to FIGS. 17 and 18, wherein instead of one set of main clamps, two sets of main clamps, one set of clamps including clamp assemblies 400 and 500 and a second set of clamps 200 and 300, are utilized and wherein two straight tube portions 9 are covered in one operation. It is appreciated that the instant invention is not limited to two clamps but can utilize any number deemed desirable.

Figure 19:
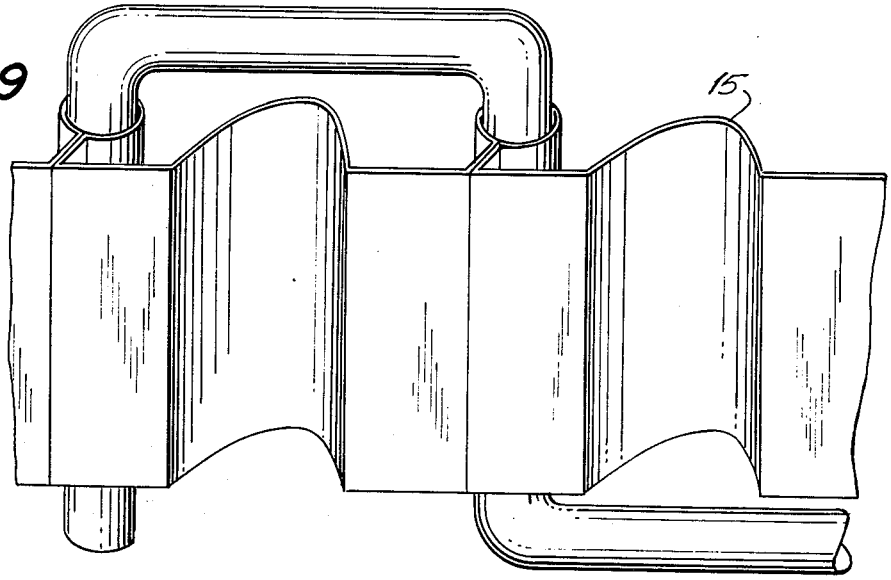
FIG. 19 is a perspective view of a tube having corrugated sheet metal folded therearound in accordance with the instant invention.

FIG. 19 depicts a construction formed in accordance with the process and apparatus of the instant invention. Such a construction is substantially ideal for use in a heat exchanger. If the groove 15 is too large or if greater advantage can be made of providing a different form thereto, then the corrugated sheet can be formed with different alternating corrugations, it being appreciated that the cross-sectional length of the unfolded corrugations must be such as to allow for the lateral widening which occurs on forming such a construction. It is noted that when the corrugation is shaped in the manner hereinabove described, only one form of corrugation is possible for a given tube diameter and a given height of the upper clamp portions, assuming the tubes are not vertically displaced during the cladding operation.

It will thus be seen that the objects set forth above, among those made apparent from the preceding description, are efficiently attained, and since certain changes may be made in carrying out the above method and in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A method of connecting a metal tube to a metal sheet suitable for use as a heat exchanger, said method comprising the steps of clamping the sheets across the width of said tube at two parallel spaced-apart locations, placing said tube between said locations parallel therewith and adjacent therewith, and displacing the clamps toward each other to effect a bending of the sheet around the tube whereby portions of the sheet are brought into contact with each other.

2. The method of bending sheet metal claimed in claim 1, wherein the sheet metal is corrugated by forcing the tube into the sheet metal prior to displacement of said clamps toward each other.

3. The method of bending sheet metal claimed in claim 1, wherein the sheet metal includes parallel corrugations, a further step including the insertion of the tube into one of the corrugations prior to the displacement of said clamps together.

4. The method of bending sheet metal claimed in claim 2, wherein the portions of the sheet metal brought into contact with each other by said clamps are permanently secured together.

5. The method of bending sheet metal claimed in claim 3, wherein the portions of the sheet metal brought into contact with each other by said clamps are permanently secured together.

6. An apparatus for connecting sheet metal to a metal tube for use as a heat exchanger comprising means for displacing said tube into said sheet metal to bend the sheet metal therearound, and means for clamping the sheet across the width of said tube at two parallel spaced-apart locations, said clamping means including a first pair of clamps on a first side of said displacing means and a second pair of clamps on the other side of said displacing means, said pairs of clamps being adapted to be displaced toward each other to bring said sheet metal together and thereby wrap said sheet metal around said tube.

7. An apparatus as claimed in claim 6 wherein said displacing means is a die beam adapted at a first position to support said tube and at a second position to force said tube into said sheet metal to effect a partial bend of said sheet metal, said displacing means including means for limiting the displacement of said clamping means toward each other.

8. An apparatus as claimed in claim 7 wherein one of said clamps of each pair has disposed thereon means for welding together said surfaces of the sheet metal brought into contact by said clamps.

9. An apparatus as claimed in claim 8 wherein said welding means includes electrodes and energizing means, said energizing means to be adapted to energize said electrodes.

10. An apparatus for connecting a metal tube to sheet metal particularly suited for use as a heat exchanger said apparatus including means for positioning said tube in a corrugation in said sheet metal and means for clamping the sheet metal across the width of said tube on both sides of said corrugation and said tube disposed therein and parallel therewith, said clamping means being adapted to be moved toward each other to thereby bring the sheet metal on each side of the tube into contact with each other and effect a wrapping of said sheet metal around said tube.

* * * * *